US009516425B2

(12) United States Patent
Daley et al.

(10) Patent No.: US 9,516,425 B2
(45) Date of Patent: Dec. 6, 2016

(54) ELECTROSTATIC SPEAKER

(71) Applicant: GOOGLE INC., Mountain View, CA (US)

(72) Inventors: Michael James Daley, Santa Clara, CA (US); Kaigham Jacob Gabriel, Pittsburgh, PA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/802,860

(22) Filed: Jul. 17, 2015

(65) Prior Publication Data

US 2015/0326978 A1 Nov. 12, 2015

Related U.S. Application Data

(62) Division of application No. 14/270,904, filed on May 6, 2014, now Pat. No. 9,143,869.

(60) Provisional application No. 61/867,307, filed on Aug. 19, 2013.

(51) Int. Cl.

| | |
|---|---|
| ***H04R 19/00*** | (2006.01) |
| ***H04R 19/02*** | (2006.01) |
| ***H04R 29/00*** | (2006.01) |

(52) U.S. Cl.

CPC ..... *H04R 19/02* (2013.01); *H04R 29/001* (2013.01); *H04R 2307/207* (2013.01); *H04R 2499/15* (2013.01)

(58) Field of Classification Search

CPC ..... H04R 19/00; H04R 19/01; H04R 19/013; H04R 19/016; H04R 17/02; H04R 19/04; H04R 19/005; H04R 9/048

USPC ..... 381/191, 173–176, 399

See application file for complete search history.

(56) References Cited

U.S. PATENT DOCUMENTS

| | | | |
|---|---|---|---|
| 2008/0152172 | A1 | 6/2008 | Matsuzawa |
| 2013/0108086 | A1 | 5/2013 | Yamashita et al. |
| 2013/0129121 | A1 | 5/2013 | Yamashita |

*Primary Examiner* — Suhan Ni

(74) *Attorney, Agent, or Firm* — Marshall, Gerstein & Borun LLP

(57) ABSTRACT

An electrostatic speaker is described that includes a curved diaphragm positioned between two electrically conductive plates. According to aspects, the curved diaphragm has an "S-shape" and is configured to electrostatically move between the conductive plates. In particular, the curved diaphragm may generally roll between the two conductive plates so as to move from left to right with respect to ends of the conductive plates and push air in a direction toward ends of the conductive plates, thus generating acoustic output. In some implementations, the configuration of the electrostatic speaker reduces a biasing voltage required for the conductive plates.

20 Claims, 8 Drawing Sheets

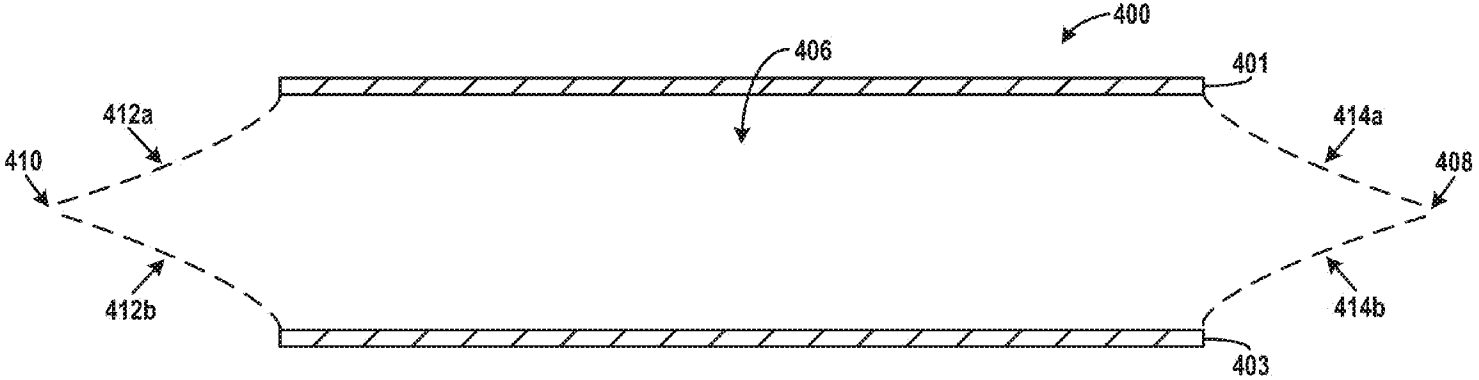
FIG. 4A Top Down Cross Section
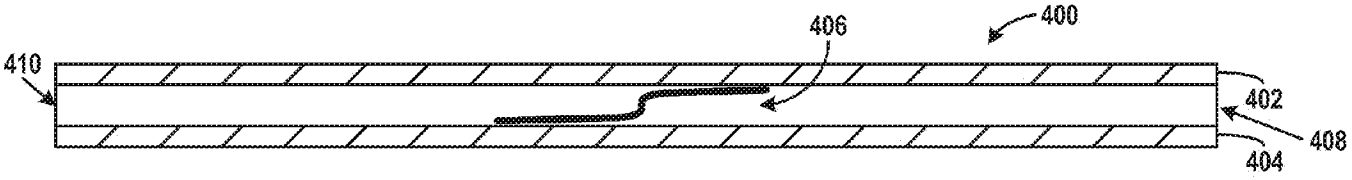
FIG. 4B Side View Cross Section
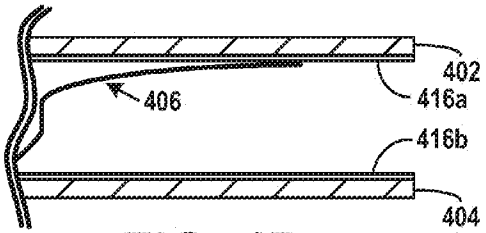
FIG. 4D
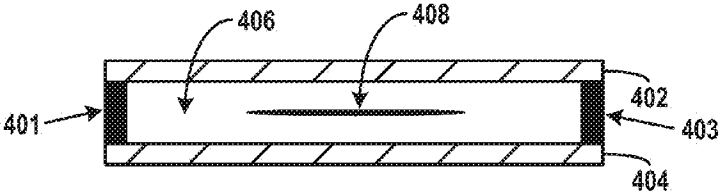
FIG. 4C Head-On Cross Section

ELECTROSTATIC SPEAKER

CROSS-REFERENCE TO RELATED APPLICATIONS

This application is a divisional of U.S. patent application Ser. No. 14/270,904, filed May 6, 2014, which claims priority benefit of U.S. Provisional Application No. 61/867,307, filed Aug. 19, 2013.

All of the above-identified patent applications are incorporated herein by reference.

FIELD

This application generally relates to electrostatic speakers. In particular, the application relates to configurations for electrostatic speakers to be included in electronic devices or standalone components for audio reproduction.

BACKGROUND

A loudspeaker is a transducer that produces sound in response to an electrical audio signal input. Conventional electrostatic loudspeakers include two perforated electrodes in between which is positioned a lightweight flexible diaphragm. The diaphragm moves perpendicular to a plane of the two electrodes when excited by a signal voltage. Through motion of the diaphragm, an acoustic output is produced by pushing air through the perforations of the two electrodes. However, existing transducer designs do not allow for certain diaphragm movements or configurations that may improve acoustic output. In particular, existing transducer designs do not allow for large deflection relative to the spacing of the electrodes. Further, the designs require a large bias voltage that can impact the required signal voltage.

Accordingly, there is an opportunity for improved electrostatic transducer designs that allow for improved audio playback.

SUMMARY

In one embodiment, an electrostatic transducer is provided. The electrostatic transducer includes a first electrode, a second electrode spaced from the first electrode at a distance which defines a region between the first electrode and the second electrode, and a diaphragm disposed in the region and having a conductive layer for being responsive to electrostatic forces to produce acoustic output. The diaphragm includes (1) a first end spaced closer to the first electrode than to the second electrode, (2) a second end spaced closer to the second electrode than to the first electrode, and (3) a curved center portion that connects the first end and the second end. The electrostatic transducer further includes at least one electrical contact respectively coupled to at least one of the first electrode, the second electrode, and the diaphragm, for coupling to an audio signal voltage source, and at least one additional electrical contact respectively coupled to at least one of the first electrode, the second electrode, and the diaphragm, for coupling to a bias voltage source.

In another embodiment, an electronic device configured to facilitate acoustic output is provided. The electronic device includes an electrostatic transducer including a first electrode, a second electrode spaced from the first electrode at a distance which defines a region between the first electrode and the second electrode, and a diaphragm disposed in the region and including (1) a first end spaced closer to the first electrode than to the second electrode, (2) a second end spaced closer to the second electrode than to the first electrode, and (3) a curved center portion that connects the first end and the second end. The electronic device further includes device electronics including a voltage source configured to apply a DC voltage to at least one of the first electrode, the second electrode, and the diaphragm, and an audio signal voltage source configured to apply an audio signal to at least one of the first electrode, the second electrode, and the diaphragm, to generate an electrostatic force in the region to drive at least a portion of the diaphragm within the region according to the applied audio signal and the applied DC voltage. Further, the electronic device includes at least one electrical contact respectively coupled to at least one of the first electrode, the second electrode, and the diaphragm, for coupling to the audio signal voltage source, and at least one additional electrical contact respectively coupled to at least one of the first electrode, the second electrode, and the diaphragm, for coupling to the voltage source.

In a further embodiment, a method of producing acoustic output from an electrostatic transducer is provided. The method includes applying a DC voltage to at least one of a first electrode, a second electrode, and a curved diaphragm, applying an audio signal to at least one of the first electrode, the second electrode, and the curved diaphragm, to generate a time-varying electrostatic field in the region and cause at least a portion of the curved diaphragm to actuate within the region and generate acoustic output, and applying a tracer signal having an initial voltage to the first electrode. Further, the method includes measuring a voltage present on the curved diaphragm resulting from the tracer signal applied to the first electrode, calculating a voltage difference between the initial voltage and the voltage present on the curved diaphragm, and based on the voltage difference, modifying at least one of the DC voltage and the audio signal.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

FIGS. 4A-4D illustrate example cross section views of a speaker in accordance with some embodiments.

DETAILED DESCRIPTION

Embodiments as detailed herein describe an electrostatic transducer that may be included in an electronic device for outputting sound. Some conventional electrostatic transducers include a thin flat diaphragm positioned between two porous electrodes. In contrast, the present embodiments describe a curved diaphragm positioned between two impermeable electrodes. The diaphragm may be configured into an S-shape, and a center portion of an S-fold of the diaphragm is configured to propagate in a wavelike or ripple-like manner as more or less of the diaphragm is pulled toward the electrodes due to voltages applied between the electrodes and the diaphragm. The movement of diaphragm causes air to be forced in and out of the electrostatic transducer via one or more openings, which creates acoustic output.

The electronic device may include various voltage and electronics sources, such as a DC voltage source and an audio signal source, configured to apply various signals to the transducer to produce acoustic output. In one embodiment, the electronic device is configured to measure certain voltages present on various components of the transducer, where the voltages correspond to a position of the diaphragm within the transducer. The electronic device can modify any of the applied signals based on the measured voltages in an effort to improve the acoustic output.

The embodiments as discussed herein offer many benefits. In particular, the described configurations of the electrostatic transducer may reduce a biasing voltage required to apply to the electrodes. Further, the configurations support techniques for dynamically modifying driving electronics which generally results in reduced distortion of the acoustic output. Of course, the embodiments further offer benefits to device users, as the transducer produces quality sound which enhances the listening experience.

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

Figure 1:
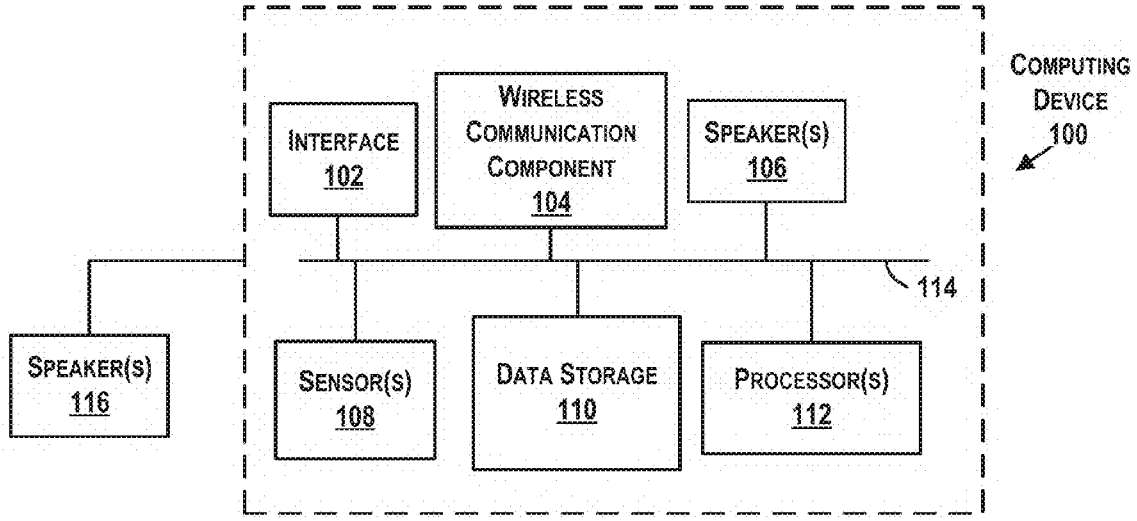
FIG. 1 is a hardware diagram of an example computing device in accordance with some embodiments.

FIG. 1 illustrates a hardware diagram of an example electronic or computing device 100. The computing device 100 may be any type of computing device such as a mobile phone, a Personal Digital Assistant (PDA), a smartphone, a tablet or laptop computer, a multimedia player, an MP3 player, a digital broadcast receiver, a remote controller, or any other electronic apparatus. The computing device 100 may be configured to transmit or receive data to and from a network. The computing device 100 may include a user interface 102, a wireless communication component 104, one or more speakers 106, sensors 108, data storage 110, and a processor 112. Components illustrated in FIG. 1 may be linked together by a communication link 114.

The user interface 102 may include a display screen, I/O components (e.g., capacitive or resistive touch sensitive input panels, keys, buttons, lights, LEDs, cursor control devices, haptic devices, and others), a microphone, and/or any other elements for receiving inputs and communicating outputs. The interface 102 may be configured to enable the computing device 100 to communicate with another computing device (not shown), such as a server.

The wireless communication component 104 may be a communication interface that is configured to facilitate wireless data communication for the computing device 100 in accordance with IEEE standards, 3GPP standards, or other standards. In particular, the wireless communication component 104 can include one or more WWAN, WLAN, and/or WPAN transceivers configured to connect the computing device 100 to various devices and components.

The data storage 110 can store an operating system capable of facilitating various functionalities as known in the art. The processor 112 can interface with the data storage 110 to execute the operating system as well as execute a set of applications (e.g., an audio playback application) or application frameworks, as well as various kernels, libraries, and runtime entities. The data storage 110 can include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others.

The speaker 106 may provide an audio output based on information received from the processor 112 or from an amplifier (not shown). The speaker 106 may include one or more speakers, or otherwise or one or more components for producing sound. The speaker 106 may be in the form of an electrodynamic, electroacoustic, or electrostatic transducer that is configured to produce sound in response to an electrical audio signal input, for example. The sensors 108 may include sensors such as an accelerometer, gyroscope, light sensors, microphone, camera, or other location and/or context-aware sensors. FIG. 1 also illustrates a separate speaker 116 that may be externally coupled to the computing device 100, and may be driven by the computing device 100 by components of the computing device 100 or by an entirely different audio source, such as a portable or stationary music player.

Figure 2A:
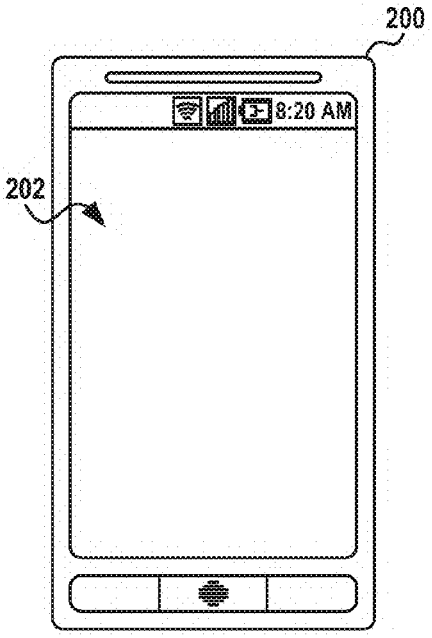
FIGS. 2A and 2B are example conceptual illustrations of a computing device in accordance with some embodiments.
Figure 2B:
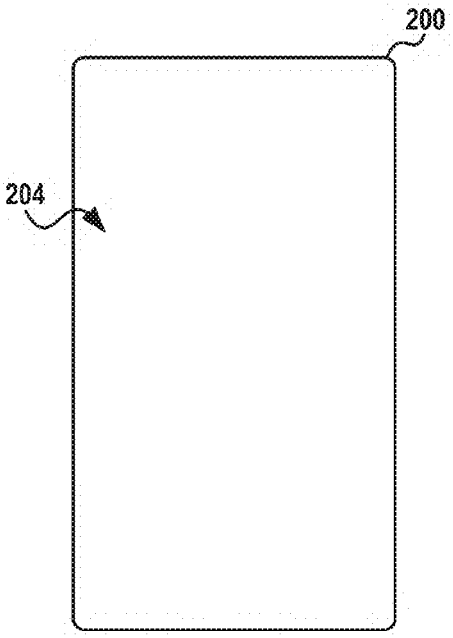

FIGS. 2A and 2B are example conceptual illustrations of a computing device 200.

The computing device 200 as illustrated may take the form of a mobile phone, and may include components as described with respect to the computing device 100 of FIG. 1. FIG. 2A illustrates a front view of the computing device 200 that includes a display 202 such as a touchscreen display. FIG. 2B illustrates a back view of the computing device 200, in which a back wall 204 of a housing of the computing device 200 is shown. The computing device 200 may include an internal speaker, whereby in some implementations, the internal speaker may have a housing comprised of a portion of the back wall 204.

Figure 3A:
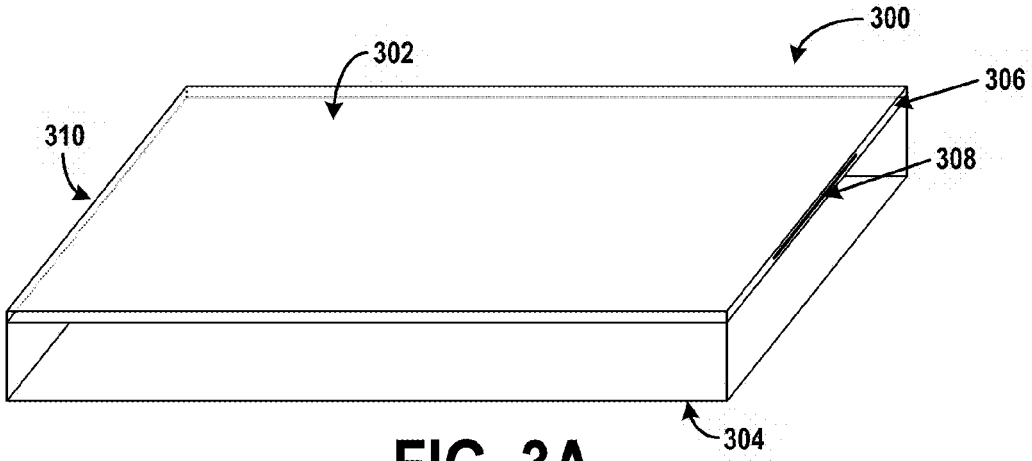
FIG. 3A is a perspective view of an example computing device in accordance with some embodiments.

FIG. 3A is a perspective view of another example computing device 300. The computing device 300 includes a back sidewall 302 and a front sidewall 304 with a display (not shown in FIG. 3A). The computing device 300 further includes a speaker 306 positioned internal to the computing device 300 in which a portion of the speaker 306 utilizes the back sidewall 302 for a structural and/or operational component. For example, an internal surface of the back sidewall 302 may include conductive material so as to operate and function as an electrode component of the speaker 306, which is described in further detail herein. The speaker 306 is configured to operate so as to push air out of one or more openings, such as openings 308 and 310, to provide acoustic output. In one configuration, one or more of the openings 308 and 310 may be exposed to an air volume within the computing device 300. In another configuration, one or more of the openings 308 and 310 may be exposed to an exterior of the computing device 300.

Figure 3B:
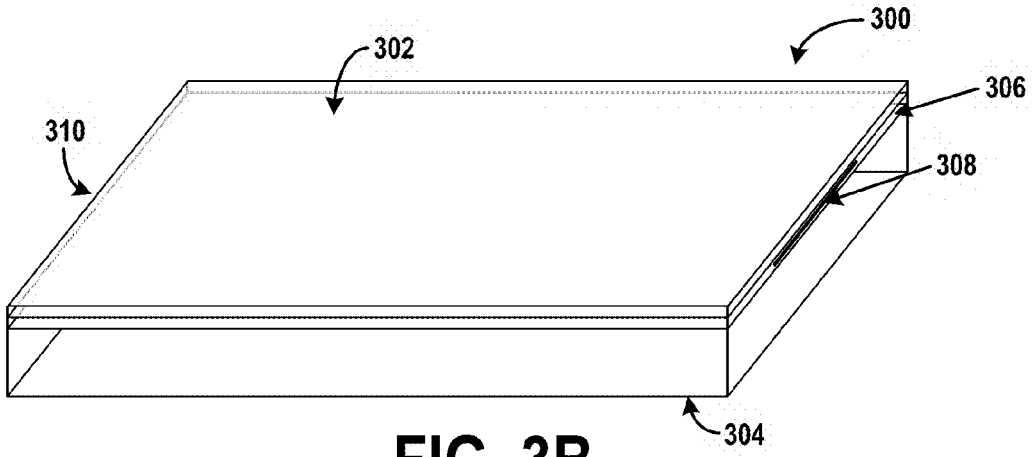
FIG. 3B is a perspective view of the computing device in FIG. 3A in which the speaker is internal to the computing device in accordance with some embodiments.

FIG. 3B is a perspective view of another implementation of the computing device 300. In particular, the computing device 300 of FIG. 3B illustrates the speaker 306 as internal to the computing device 306 whereby the computing device 300 does not utilize the back sidewall 302 for structure of the speaker 306.

Figure 3C:
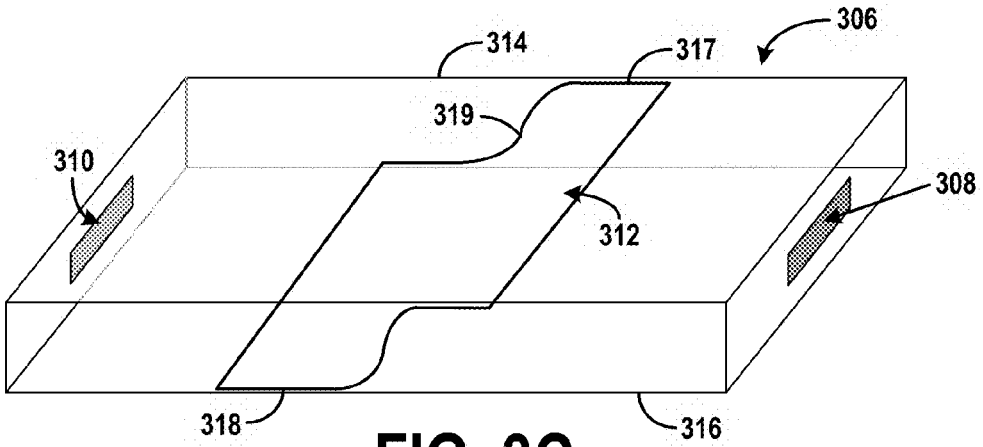
FIG. 3C is a perspective view of the speaker in FIGS. 3A and 3B in accordance with some embodiments.

FIG. 3C is a perspective view of the speaker 306. The speaker 306 may be configured as an electrostatic loudspeaker in which sound is generated by movement of a membrane or diaphragm. Thus, the speaker 306 includes a diaphragm 312 positioned between two electrically conductive plates (i.e., electrodes) 314 and 316. The speaker 306 may be included in the computing device 300, such as the computing device 300 illustrated in FIG. 3A, whereby an internal surface of the back sidewall 302 may be configured as an electrically conductive plate or electrode, whereby another electrically conductive plate 316 or electrode may be provided for the speaker 306 structure. Thus, in this implementation, the speaker 306 is provided as an internal component of the computing device 300.

In some implementations, the speaker 306 may be a stand-alone component provided in a housing with input ports to receive an input drive signal. The speaker 306 may also be coupled to any type of device or amplifier, and may be configured as a portable speaker as well, and may take the form of the external speaker 116 shown in FIG. 1, for example.

The diaphragm 312 may be disposed between the two electrically conductive plates 314 and 316, and an insulation layer (not shown in FIG. 3C) may be present between the two electrically conductive plates 314 and 316 and the diaphragm 312. The insulation layer may be disposed on the conductive plates 314 and 316, on the diaphragm 312, or on both the conductive plates 314 and 316 and the diaphragm 312, such that when the diaphragm 312 contacts the conductive plates 314 and 316, there is no short-circuit of the speaker 306.

The electrically conductive plates 314 and 316 may comprise a conductive material, such as traces on a PC board or FR-4 material. The electrically conductive plates 314 and 316 may also include an insulator over the electrically conductive material. In embodiments, the electrically conductive plates 314 and 316 may be configured with no perforations or other porous elements (i.e., may be impermeable). The electrically conductive plates 314 and 316 may be approximately as long and wide as the computing device 300, or may be smaller than the dimensions of the computing device 300. For example, the electrically conductive plates 314 and 316 may be about 50 mm wide by about 130 mm length, and may be spaced apart about 1 mm.

The diaphragm 312 may comprise a plastic sheet coated with a conductive material, such as graphite. In other examples, the diaphragm 312 may be comprised of a polyester film, such as a PET film, or comprised of a metalized Mylar material. In addition, the diaphragm 312 may also include an insulating layer over the conductive material. For example, the diaphragm 312 may include a layer of metalized polyimide film such as DuPont® Kapton®.

The diaphragm 312 as shown in FIG. 3C has a curved "S-shape," whereby the diaphragm 312 may be disposed between the electrically conductive plates 314 and 316 in any configuration (e.g., forward "S", backward "S", etc.). The diaphragm 312 may also be configured in other shapes or in variations of an S-shape (e.g., variations of parameters of an S-shape), such that a curved portion is longer or shorter, or such that a slope is larger or smaller, for example. Generally, as illustrated in FIG. 3C, the diaphragm 312 includes a first end 317 spaced closer to the electrically conductive plate 314 than to the electrically conductive plate 316, and a second end 318 spaced closer to the electrically conductive plate 316 than to the electrically conductive plate 314. Further, the diaphragm 312 includes a curved center portion 319 that connects the first end and the second end. The diaphragm 312 may have different thicknesses, for example about 2-100 micrometers thick, and may be positioned in a center of the speaker 306 structure. The diaphragm 312 may further have different dimensions, for example about 5-50 mm in length and about 1-10 mm in length from a top to bottom of the S-shape.

FIGS. 4A-4D illustrate example cross section views of a speaker 400. The speaker 400 may be configured as shown in FIG. 3C, for example.

FIG. 4A illustrates a top down cross section view of a portion of the speaker 400. The speaker 400 includes two electrodes (not shown) and a diaphragm 406 disposed between the two electrodes. FIG. 4A illustrates sidewalls 401 and 403 due to the top down cross section, and the diaphragm 406 extending along the sidewalls 401 and 403. Openings 408 and 410 are provided in the speaker 400 through which air is pushed for acoustic output. The speaker 400 is shown with tube structures comprised of walls 412*a-b* and 414*a-b* through which the acoustic output travels. The tube structures are optional, and may be provided to couple the acoustic outlets to internal or external features of the electronic device. Alternately, the tube structures may be replaced by a series of tubes or chambers (e.g., with differences in sizes, or a series of expansion/contraction chambers) to form other types of acoustic filters.

FIG. 4B illustrates a side cross section view of the speaker 400. The side cross section view details a first electrode 402, a second electrode 404, and the diaphragm 406 in an S-shape. A position of the S-fold of the diaphragm 406 may be offset from center so as to be toward an end of the speaker 400 to adjust filtering of acoustic sound. For example, filtering of the acoustic sound can be performed through tube structures and/or positioning of the S-fold to realize a phase difference between acoustic outputs at openings 408 and 410 so as to modify cancellations.

FIG. 4C illustrates a head-on cross section view of the speaker 400 in which one of the openings 408 is shown and FIG. 4D illustrates a magnified view of a portion of the side view cross section of the speaker 400. In FIG. 4D, each of the two conductive electrodes 402 and 404 includes an insulation layer 416*a-b*. In operation, end portions of the diaphragm 406 may be pinned due to electrostatic force to the conductive electrodes 402 and 404, and the insulation layers 416*a-b* ensure that no short circuit forms between the diaphragm 406 and the conductive electrodes 402 and 404. In another example, the insulation layers 416*a-b* may not be present; instead, the diaphragm 406 may include an insulation layer (not shown) to provide insulation between the diaphragm 406 and the conductive electrodes 402 and 404.

Figure 5A:
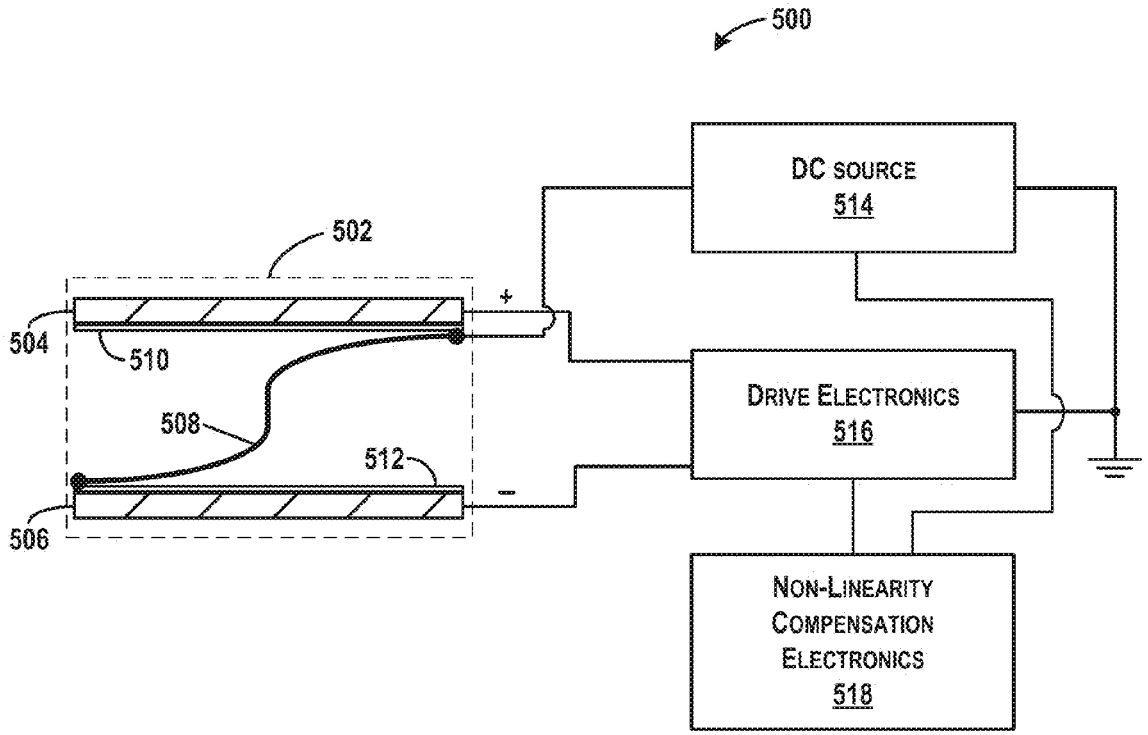
FIG. 5A illustrates a block diagram of an example computing device in accordance with some embodiments.

FIG. 5A illustrates a block diagram of an example electronic device 500. The electronic device 500 includes a speaker 502 (i.e., electrostatic transducer), which may be configured as any of the speakers described in FIG. 3C and FIGS. 4A-4D. FIG. 5A illustrates a magnified view of a portion of the speaker 502, where the speaker 502 includes two electrodes 504 and 506 and a diaphragm 508 disposed between the two electrodes 504 and 506. Each of the two electrodes 504 and 506 may include an insulation layer 510 and 512 which may contact respective ends of the diaphragm 508.

A DC source 514 is coupled, via an electrical contact, to the diaphragm 508 to hold the diaphragm 508 at a DC potential with respect to the two electrodes 504 and 506. The two electrodes 504 and 506 are coupled to drive electronics 516 via electrical contacts, which can be driven by an audio signal. As a result, an electrostatic field related to the audio signal is produced, which may cause a force to be exerted on the diaphragm 508. The diaphragm 508, which may be configured as an S-shape, may move in a wavelike manner due to the electrostatic forces between the diaphragm 508 and the electrode 504, and between the diaphragm 508 and the electrode 506. In particular, the S-fold of the diaphragm 508 may change position in a wavelike manner, and ends of the diaphragm 508 may be generally stationary as a result of the electrostatic forces and mechanical features pinning the ends of the diaphragm 508 to the insulation layers 510 and 512 of the conductive electrodes 504 and 506. A resulting movement of the diaphragm 508 drives air on either side of the diaphragm 508 to produce two acoustic outputs.

The device 500 is configured to operate by receiving a voltage input and providing an acoustic pressure output that is proportional to the voltage input. There are at least two dominant sources of non-linearity within the device 500: a first source may be due to a gap between the diaphragm 508 and the electrodes 504 and 506 changing by a large percentage as the diaphragm 508 moves within the speaker 502, and a second source may be due to the electrostatic force itself being nonlinear. Thus, the device 500 may also include non-linearity compensation electronics 518 that are configured to modify the signals provided to the two electrodes 504 and 506 by the drive electronics 516, and/or to modify the signals provided to the diaphragm 508 by the DC source 514 so as to remove distortion and create linear (or linear-like) acoustic outputs. The non-linearity compensation electronics 518 may pre-compensate for possible distortion in the output acoustic signal. Thus, the DC source 514 may provide a DC signal or a DC and added pre-undistortion signal(s) to the diaphragm 508, and the drive electronics 516 may provide a drive signal or a drive signal and added pre-undistortion signal(s) to the conductive electrodes 504 and 506.

The drive electronics 516 may be configured to provide signals out of phase to the two electrodes 504 and 506. As mentioned, in some examples, a DC bias may be added to a signal provided to one of the electrodes 504 or 506, to signals provided to both of the electrodes 504 and 506, or to a signal provided to the moving diaphragm 508. The DC bias can be provided to further manage distortion or adjust sensitivity.

The device 500 in FIG. 5A may be configured as a speaker device. In some implementations, the DC source 514, drive electronics 516, and non-linearity compensation electronics 518 may be separate components from the speaker 502, so that the speaker 502 is a stand-alone component. Further, although one circuit configuration is illustrated in FIG. 5A, it should be appreciated that other circuit configurations for driving the speaker 502 are envisioned. For example, the DC source 514 may drive the electrode 504, the electrode 506 may be grounded, and the diaphragm 508 may be connected to a DC source configured to apply an AC signal.

Figure 5B:
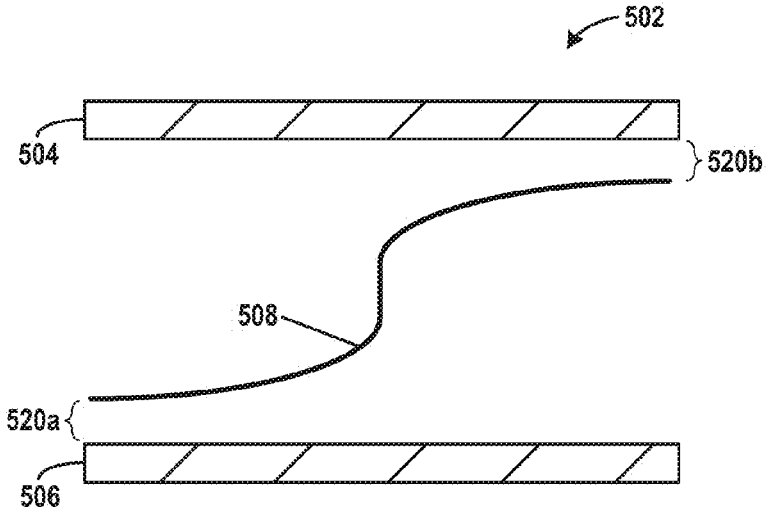
FIG. 5B-5C illustrates a portion of the computing device in FIG. 5A in accordance with some embodiments.

FIG. 5B illustrates a speaker portion 502 of the computing device 500 as described with respect to FIG. 5A. Ends of the diaphragm 508 are shown such that gaps 520*a-b* are present between the ends of the diaphragm 508 and the two electrodes 504 and 506. The gaps 520*a-b* approach zero width as the diaphragm 508 extends toward ends of the two electrodes 504 and 506, where such a configuration enables a large force to be produced on the diaphragm 508 due to a small applied voltage. In one implementation, the gaps 520*a-b* may be filled with the insulation layers 510 and 512.

According to embodiments, voltages needed to achieve a given force to accelerate the diaphragm 508 are reduced by making the gaps 520*a-b* approach zero over a portion of the speaker 502. Conventional electrostatic loudspeaker designs may have a gap between a membrane and electrodes, and may move the membrane over a small percentage of the gap. However, according to some configurations described herein, the diaphragm 508 is configured to move over a large percentage of space within a center portion of the speaker 502, and to move near zero movement at the gaps 520*a-b*. A benefit of such a configuration is that small voltage changes can cause large deflections, such as ±10 mm peak.

Figure 5C:
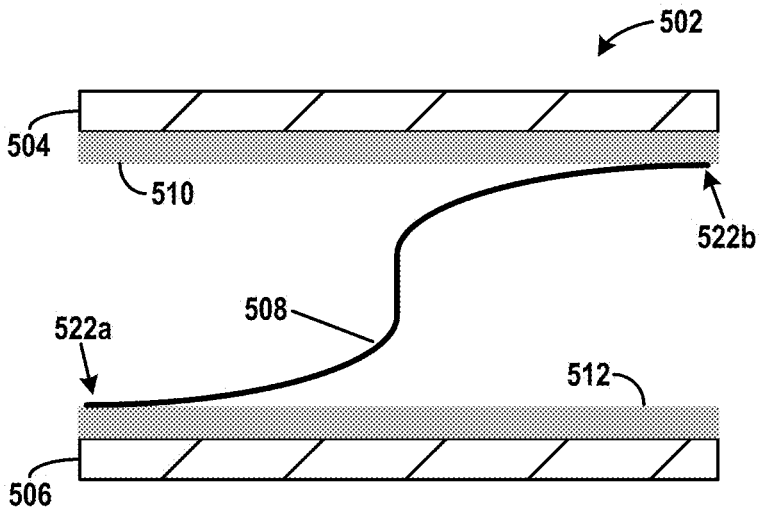
Figure 5D:
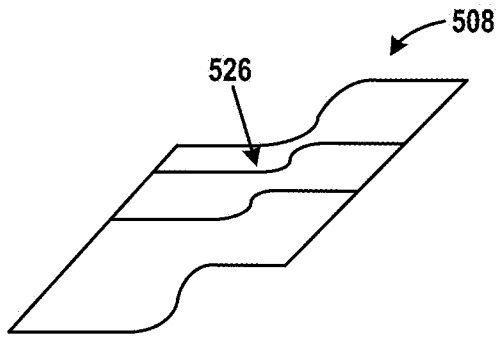
FIG. 5D illustrates an example configuration of a diaphragm in accordance with some embodiments.

The edges of the diaphragm 508 may be affixed to a structure so that a middle portion may flex in a wavelike or rolling manner. FIG. 5C illustrates a configuration of the ends of the diaphragm 508 in a fixed position. In particular, FIG. 5C illustrates a configuration whereby ends 522*a-b* of the diaphragm 508 are each coupled to the insulation layers 510 and 512 of the electrodes 506 and 504, respectively. This configuration enables a seal to be established to separate air from left to right of the diaphragm 508 and from top to bottom of the diaphragm 508. FIG. 5E illustrates an additional configuration of the diaphragm 508. In particular, the diaphragm 508 of FIG. 5E is shown with corrugations, creases, or folds 526 that enable a smooth S-fold shape and run along an entire length of the diaphragm 508 from left to right. A series of folds 526 can be provided (any number may be provided although only two are shown in FIG. 5E) to further enable a portion of the diaphragm 508 to contact a top and bottom electrode 504 and 506 and provide some strain relief (or expansion) such that the S-fold portion can move with an established acoustic seal. In other configurations, the diaphragm 508 may be comprised of a material that enables flexing as well so that the folds are not needed.

By affixing ends 522*a-b* of the diaphragm 508 and providing corrugations 526 in the diaphragm 508, the diaphragm 508 may be forced to move with low tension.

Figure 6:
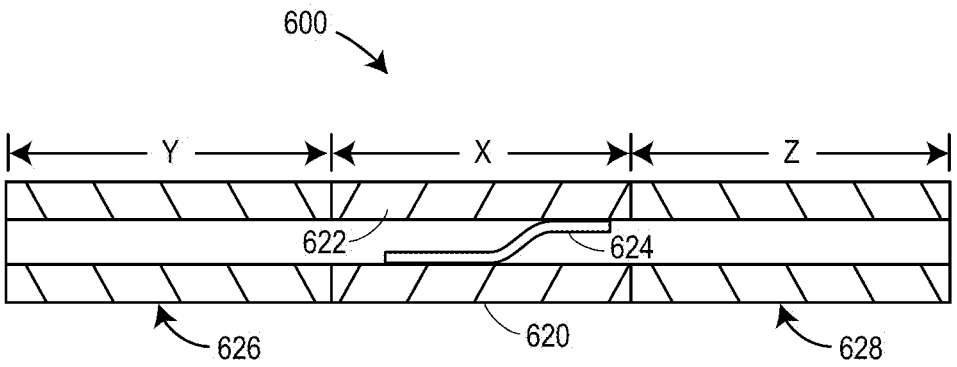
FIG. 6 illustrates an example cross section view of a portion of a computing device in accordance with some embodiments.

FIG. 6 illustrates a cross-section view 600 of an electrostatic transducer and related components. In particular, the electrostatic transducer may occupy the "x" section as indicated in FIG. 6. The electrostatic transducer may include a first electrode 622, a second electrode 620, and a curved diaphragm 624 having an S-shape or other curved shape. The cross-section view 600 further illustrates passive acoustic components that may occupy the "y" and "z" sections as indicated in FIG. 6. In particular, a first passive acoustic component 626 may extend from one end of one or more of the first electrode 622 and the second electrode 620, and a second passive acoustic component 628 may extend from another end of one or more of the first electrode 622 and the second electrode 620. The electrostatic transducer, the first passive acoustic component 626, and the second passive acoustic component 628 may collectively be disposed within an electronic device.

As illustrated in FIG. 6, the first passive acoustic component 626 and the second passive acoustic component 628 may extend from the respective ends of the first electrode 622 and/or the second electrode 620 in a co-planar manner. In this configuration, the first passive acoustic component 626 and/or the second passive acoustic component 628 may be physical components such as a pipe, a surface or component of the electronic device, or other physical, passive components.

Although illustrated as physical components in FIG. 6, it should be appreciated that the passive acoustic components 626, 628 may be other forms, in which case there may be a singular passive acoustic component. For example, the passive acoustic components 626, 628 may be a back volume or a port of the associated electronic device, or other passive channels or features. It should further be appreciated that the passive acoustic components 626, 628 may extend to an exterior of the electronic device or may terminate within the electronic device.

Figure 7:
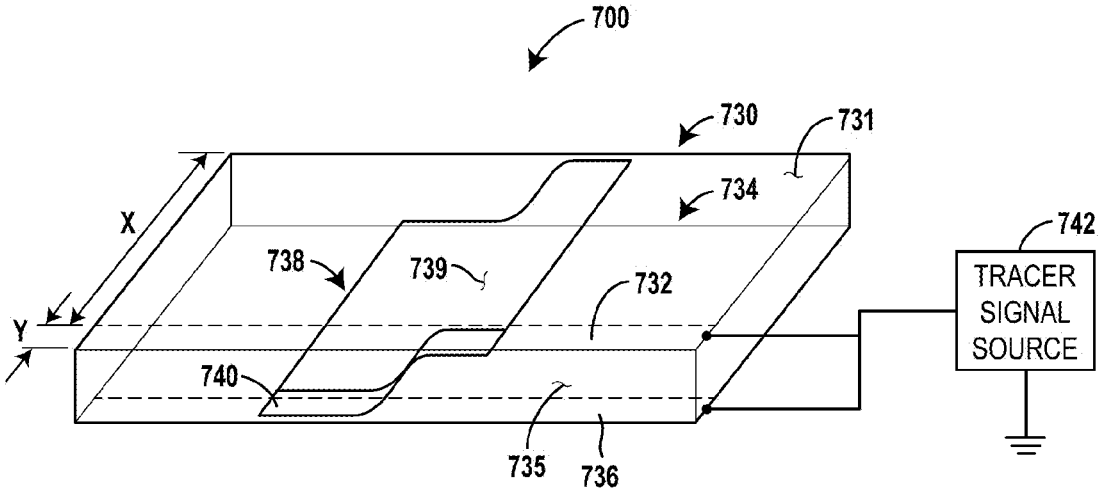
FIG. 7 illustrates a perspective view of a transducer in accordance with some embodiments.

FIG. 7 is a perspective view of an example electrostatic transducer 700. Similar to FIG. 3, the electrostatic transducer 700 includes a first electrode 730 and a second electrode 734 with a curved diaphragm 738 disposed therebetween. According to embodiments, the first electrode 730 can include multiple components: a first electrode component 732 and a second electrode component 731. It should be appreciated that the first electrode component 732 and the second electrode component 731 are electrically distinct and mechanically coupled. Similarly, the second electrode 734 can include a first electrode component 736 and a second electrode component 735 that are also electrically distinct and mechanically coupled. Further, the curved diaphragm 738 can include a first diaphragm section 740 and a second diaphragm section 739 that are also electrically distinct and mechanically coupled.

According to embodiments, the components and sections of the first electrode 730, the second electrode 734, and the curved diaphragm 738 may be sized differently. As illustrated in FIG. 7, the respective first portions/components 732, 736, 740 take up the "y" section and the respective second portions/components 731, 735, 739 take up the "x" section, whereby the "x" and "y" sections may be sized according to various proportions. For example, the "y" section (and the corresponding first portions/components 732, 736, 740) may take up 10% of the width of the speaker component 700, and the "x" section may take up the remaining 90% of the width of the speaker component 700.

To produce acoustic output, the electronic device is configured to apply the audio signal and/or the DC voltage to any one of the second electrode component 731 of the first electrode 730, the second electrode component 735 of the second electrode 734, or the second diaphragm section 739. Further, in an effort to improve the acoustic output (e.g., to reduce distortion), the electronic device can modify the applied audio signal and/or DC voltage. As illustrated in FIG. 7, the electronic device can include a tracer signal source 742. In operation, the tracer signal source 742 can apply a tracer signal to either the first electrode component 732 of the first electrode 730 or the first electrode component 736 of the second electrode 734. The tracer signal has an associated initial voltage. Further, the tracer signal may cause a voltage to be present on the curved diaphragm 738. For example, the tracer signal source 742 applying a tracer signal to the first electrode component 732 may cause a voltage to be present on the corresponding first diaphragm section 740 of the curved diaphragm 738.

The electronic device may be configured to measure the voltage present on first diaphragm section 740 of the curved diaphragm 738 and a processor of the electronic device may compare the measured voltage to the initial voltage of the tracer signal. The difference between the measured voltage and the initial voltage may represent or correspond to the position of the curved section of the diaphragm 738 between the first electrode 730 and the second electrode 734. The time-varying position of the curved diaphragm 738 may affect the quality of the acoustic output from the electronic device. Accordingly, the processor may adjust the audio signal and/or the DC voltage based on the inferred diaphragm position, and may cause the electronic device to apply the modified audio signal and/or DC voltage to any one of the second electrode component 731 of the first electrode 730, the second electrode component 735 of the second electrode 734, or the second diaphragm section 739 to ensure a desired relationship between the intended audio signal and the position of the diaphragm 738. Although not illustrated in FIG. 7, it should be appreciated that the tracer signal source 742, voltage measuring capabilities, and signal modification capabilities are also envisioned for single electrode and diaphragm components (i.e., electrodes and diaphragms that are not segmented into multiple components or partitions).

Figure 8:
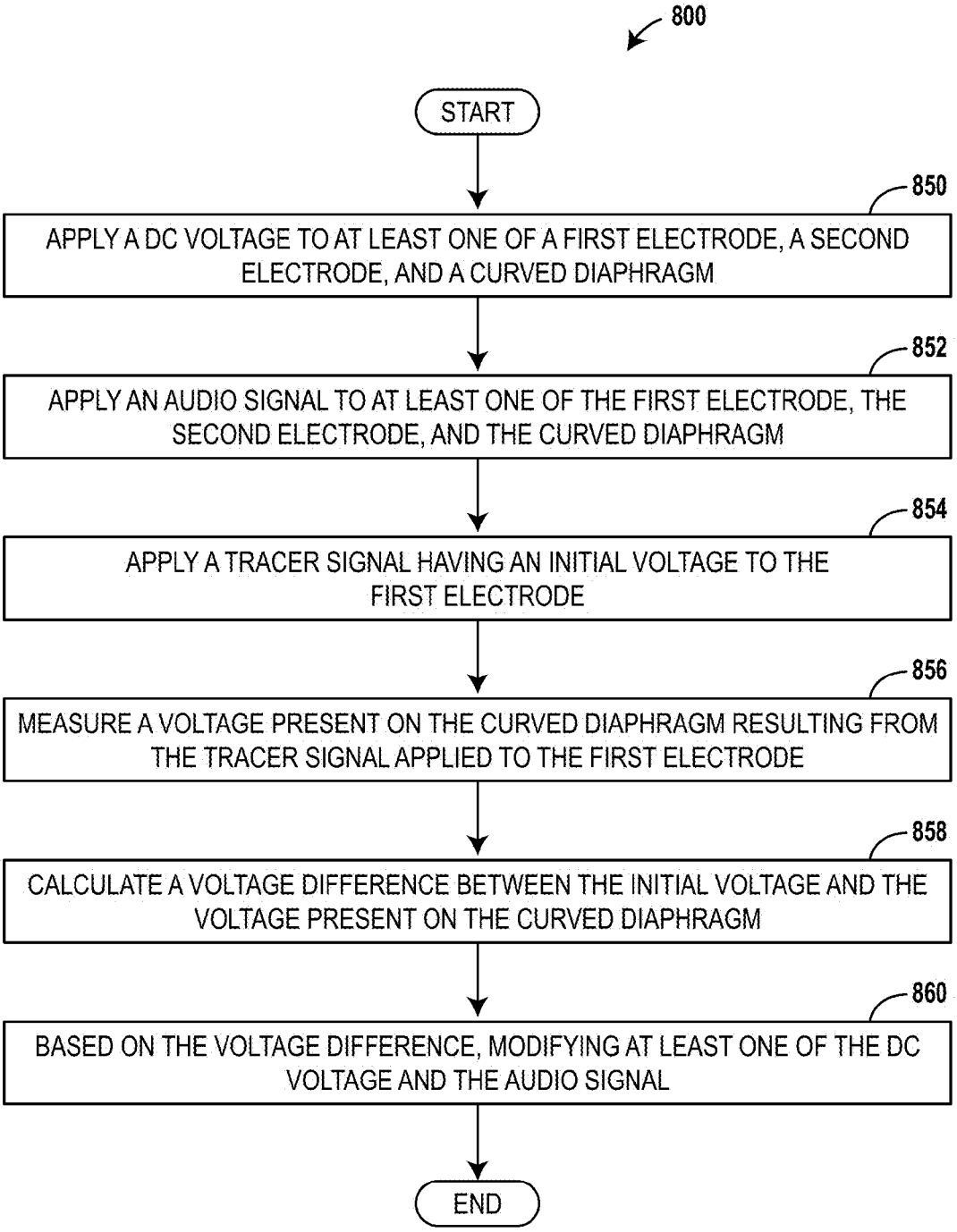
FIG. 8 is a block diagram of an example method for producing an acoustic output, in accordance with some embodiments.

FIG. 8 is a block diagram of an example method 800 for producing an acoustic output from an electrostatic transducer, in accordance with at least some embodiments described herein. The method 800 illustrated in FIG. 8 presents an embodiment of a method that, for example, could be used with the devices in FIGS. 1-7. The various blocks may be combined into fewer blocks, divided into additional blocks, and/or removed based upon the desired implementation.

In addition, for the method 800 and other processes and methods disclosed herein, the flowchart depicts functionality and operation of one possible implementation of the present embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include a non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, a tangible storage device, or other article of manufacture, for example. Alternatively, the method may be implemented as a feedback system in a combination of circuitry and software.

According to embodiments, the electrostatic transducer includes a first electrode, a second electrode spaced from the first electrode at a distance which defines a region between the first electrode and the second electrode, and a curved diaphragm disposed in the region. The curved diaphragm may include a first end spaced closer to the first electrode than to the second electrode, a second end spaced closer to the second electrode than to the first electrode, and a curved center portion that connects the first end and the second end.

The method 800 begins with the electronic device applying (block 850) a DC voltage to at least one of the first electrode, the second electrode, and the curved diaphragm. In some embodiments, the curved diaphragm may include a first diaphragm section and a second diaphragm section, and the first electrode may include a first electrode component and a second electrode component, such that the first electrode component and the second electrode component are (i) electrically distinct and (ii) mechanically coupled. Accordingly, the electronic device may apply the DC voltage to at least one of the second electrode component of the first electrode, the second electrode, and the second diaphragm section.

The electronic device can apply (block 852) an audio signal to at least one of the first electrode, the second electrode, and the curved diaphragm. In some embodiments, the electronic device can apply the audio signal to at least one of the second electrode component of the first electrode, the second electrode, and the second diaphragm section. In some cases, applying the audio signal may cause at least a portion of the curved diaphragm to actuate in a direction perpendicular to respective planes defined by the first and second electrodes. In other cases, applying the audio signal causes a curved center portion of the curved diaphragm to actuate in a direction parallel to respective planes defined by the first and second electrodes. The electronic device can also apply (block 854) a tracer signal having an initial voltage to the first electrode. In some embodiments, the electronic device may apply the tracer signal to the first electrode component.

The electronic device can measure (block 856) a voltage present on the curved diaphragm resulting from the tracer signal applied to the first electrode (or the first electrode component). The electronic device can also calculate (block 858) a voltage difference between the initial voltage and the voltage present on the curved diaphragm. The voltage difference may correspond to the diaphragm position between the first electrode and the second electrode and, in an attempt to improve the audio output, the electronic device can compensate for the diaphragm position. Accordingly, the electronic device can modify (block 860) at least one of the DC voltage and the audio signal based on the voltage difference. According to embodiments, the modified DC voltage and/or audio signal causes modifications in the diaphragm movement and/or position and effectively improves acoustic output from the electronic device.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the claims, along with the full scope of equivalents to which such claims are entitled. It is also to be understood that the terminology used herein is for the purpose of describing particular only, and is not intended to be limiting.

The invention claimed is:

1. An electronic device configured to facilitate acoustic output, comprising:

an electrostatic transducer comprising:

a first electrode, a second electrode spaced from the first electrode at a distance which defines a region between the first electrode and the second electrode, and a diaphragm disposed in the region and including (1) a first end spaced closer to the first electrode than to the second electrode, (2) a second end spaced closer to the second electrode than to the first electrode, and (3) a curved center portion that connects the first end and the second end;

device electronics comprising:

a voltage source configured to apply a DC voltage to at least one of the first electrode, the second electrode, and the diaphragm, and an audio signal source configured to apply an audio signal to at least one of the first electrode, the second electrode, and the diaphragm, to generate an electrostatic force in the region to drive at least a portion of the diaphragm within the region according to the applied audio signal and the applied DC voltage;

at least one electrical contact (i) coupled to the audio signal source and (ii) respectively coupled to at least one of the first electrode, the second electrode, and the diaphragm; and at least one additional electrical contact (i) coupled to the voltage source and (ii) respectively coupled to at least one of the first electrode, the second electrode, and the diaphragm.

2. The electronic device of claim 1, further comprising a processor configured to perform at least one of:

cause the voltage source to modify the DC voltage, and cause the audio signal source to modify the audio signal.

3. The electronic device of claim 2, wherein a tracer signal having an initial voltage is applied to the first electrode, and wherein the processor is further configured to:

measure a voltage present on the diaphragm resulting from the tracer signal applied to the first electrode, calculate a voltage difference between the initial voltage and the voltage present on the diaphragm, and based on the voltage difference, cause at least one of (1) the voltage source to modify the DC voltage and (2) the audio signal source to modify the audio signal.

4. The electronic device of claim 3, wherein the first electrode includes a first electrode component and a second electrode component, wherein the first electrode component and the second electrode component are (i) electrically distinct and (ii) mechanically coupled, and wherein the tracer signal is applied to the first electrode component.

5. The electronic device of claim 3, wherein to cause the at least one of (1) the voltage source to modify the DC voltage and (2) the audio signal source to modify the audio signal, the processor is configured to:

cause the voltage source to apply the DC voltage and an added pre-undistortion signal to the diaphragm.

6. The electronic device of claim 3, wherein to cause the at least one of (1) the voltage source to modify the DC voltage and (2) the audio signal source to modify the audio signal, the processor is configured to:

cause the audio source to apply the audio signal and an added pre-undistortion signal to at least one of the first electrode and the second electrode.

7. The electronic device of claim 1, wherein the electrostatic transducer further comprises:

a first insulation layer disposed between the first electrode and the diaphragm, and a second insulation layer disposed between the second electrode and the diaphragm.

8. The electronic device of claim 7, wherein the first electrode is disposed between the first insulation layer and a first non-conductive surface, and wherein the second electrode is disposed between the second insulation layer and a second non-conductive surface.

9. The electronic device of claim 1, wherein the second electrode is spaced from the first electrode at the distance which further defines (1) a first opening at a first end of the electrostatic transducer and (2) a second opening at a second end of the electrostatic transducer.

10. The electronic device of claim 9, wherein the electronic device encloses an air volume, and wherein the first opening is exposed to the air volume and the second opening is exposed to an exterior of the electronic device.

11. The electronic device of claim 9, wherein each of the first opening and the second opening is exposed to an exterior of the electronic device.

12. The electronic device of claim 1, further comprising:

a first passive acoustic component extending from the first electrode to at least one end of the electrostatic transducer, and a second passive acoustic component extending from the second electrode to the at least one end of the electrostatic transducer.

13. The electronic device of claim 1, wherein each of the first electrode and the second electrode is impermeable.

14. A method of producing acoustic output from an electrostatic transducer comprising a first electrode, a second electrode spaced from the first electrode at a distance which defines a region between the first electrode and the second electrode, and a curved diaphragm disposed in the region, the method comprising:

applying a DC voltage to at least one of the first electrode, the second electrode, and the curved diaphragm;

applying an audio signal to at least one of the first electrode, the second electrode, and the curved diaphragm, to generate an electrostatic field in the region and cause at least a portion of the curved diaphragm to actuate within the region and generate acoustic output;

applying a tracer signal having an initial voltage to the first electrode;

measuring a voltage present on the curved diaphragm resulting from the tracer signal applied to the first electrode;

calculating a voltage difference between the initial voltage and the voltage present on the curved diaphragm; and based on the voltage difference, modifying at least one of the DC voltage and the audio signal.

15. The method of claim 14, wherein applying the audio signal causes at least a portion of the curved diaphragm to actuate in a direction perpendicular to respective planes defined by the first and second electrodes.

16. The method of claim 14, wherein applying the audio signal causes a curved center portion of the curved diaphragm to actuate in a direction parallel to respective planes defined by the first and second electrodes.

17. The method of claim 14, wherein the curved diaphragm includes a first diaphragm section and a second diaphragm section, wherein the first electrode includes a first electrode component and a second electrode component, wherein the first electrode component and the second electrode component are (i) electrically distinct and (ii) mechanically coupled, wherein applying the tracer signal comprises:

applying the tracer signal to the first electrode component, and wherein measuring the voltage comprises:

measuring the voltage present on the first diaphragm section resulting from the tracer signal applied to the first electrode component.

18. The method of claim 17, wherein applying the DC voltage comprises:

applying the DC voltage to at least one of the second electrode component of the first electrode, the second electrode, and the second diaphragm section; and wherein applying the audio signal comprises:

applying the audio signal to at least one of the second electrode component of the first electrode, the second electrode, and the second diaphragm section.

19. The method of claim 14, wherein modifying the at least one of the DC voltage and the audio signal comprises:

applying the DC voltage and an added pre-undistortion signal to the curved diaphragm.

20. The method of claim 14, wherein modifying the at least one of the DC voltage and the audio signal comprises:

applying the audio signal and an added pre-undistortion signal to at least one of the first electrode and the second electrode.

* * * * *